US007874845B1

(12) United States Patent
Tang et al.

(10) Patent No.: US 7,874,845 B1
(45) Date of Patent: Jan. 25, 2011

(54) SCISSOR-TYPE MULTI-FUNCTIONAL CONNECTOR

(75) Inventors: Chun-Yuan Tang, Shenzhen (CN); Bin Di, Shenzhen (CN); Xiao-Song Guo, Shenzhen (CN)

(73) Assignee: Amphenol East Asia Electronic Technology (Shenzhen) Ltd., Shenzhen, Guangdong Province (CN)

( * ) Notice: Subject to any disclaimer, the term of this patent is extended or adjusted under 35 U.S.C. 154(b) by 0 days.

(21) Appl. No.: 12/700,662

(22) Filed: Feb. 4, 2010

(51) Int. Cl.
*H01R 12/00* (2006.01)

(52) U.S. Cl. ..... 439/65

(58) Field of Classification Search ..... 439/65, 439/650, 651–655, 69
See application file for complete search history.

(56) References Cited

U.S. PATENT DOCUMENTS 4,657,320 A * 4/1987 Bamford et al. ..... 439/31
4,703,394 A * 10/1987 Petit et al. ..... 361/790
4,820,169 A * 4/1989 Weber et al. ..... 439/65
6,488,540 B2 * 12/2002 Coyle et al. ..... 439/650

* cited by examiner

*Primary Examiner*—Chandrika Prasad
(74) *Attorney, Agent, or Firm*—Leong C. Lei

(57) ABSTRACT

A scissor-type multi-functional connector includes a male connector and a female connector respectively mounted to circuit substrates. The male connector includes a housing that includes a frame wall and receives and retains therein plate terminals. The female connector includes a housing and a lower body between which clips are retained. Both connectors are mounted to the substrates by pins. Contact legs of the plate terminals and the clips extend outside the housings and are mounted to the substrates through SMT or PCB soldering (DIP). As such, the frame wall of the male housing may be set to mate the female housing to have the plate terminals and the clips efficiently and effectively engaging each other to form a connected condition.

10 Claims, 4 Drawing Sheets

SCISSOR-TYPE MULTI-FUNCTIONAL CONNECTOR

(a) TECHNICAL FIELD OF THE INVENTION

The present invention generally relates to a structure of multi-functional connector, and more particularly to a connector featuring easy operation and simple structure.

(b) DESCRIPTION OF THE PRIOR ART

The arrangement of printed circuit board assembly (PCBA) allows various electronic components to be collectively mounted on a printed circuit board. With the progress of technology and science, PCBA finds very wide applications, which can be as a device as small as an electronic watch, or as large as a main board of a computer. Further, the development of wireless technology is integrated in the function of circuit boards and thus finds its applications in daily living of human beings. However, connection between circuit board by wires (metal wires) shows certain drawbacks including being hard for maintenance, poor efficiency of assembling, and poor compatibility. These are problems to be improved in the industry.

SUMMARY OF THE INVENTION

The primary objective of the present invention is to provide a multi-functional connector, which realizes transmission of multiple signals between printed circuit board assemblies according to practical situations. The connector is capable of simultaneous transmission of radio frequency (RF) signals, regular control signals, and power and shows excellent compatibility. The connector adopts surface-mount technology (SMT) or insertion and soldering to a PCB (such as DIP) so as to render high efficiency of assembling, excellent stability, and ease of maintenance and also offer an excellent function of position-shifted connection to thereby realize convenient installation and operation for inspection operators.

The technical feature of the present invention is that a scissor-type multi-functional connector comprises a male device and a female device respectively mounted to substrate boards with pins, wherein the male device comprises a housing, at least three plate terminals, and the pins, the housing forming a plurality of receiving slots for receiving the plate terminals, the housing forming a plurality of spaces arranged in a direction for accommodating a configuration of the respective plate terminal, each of the plate terminals forming a rearward-extending contact leg; and the female device comprises an upper cover, the pins, clips, and a lower body, the upper cover having a plurality of shielding plates extending frontward for mating spacer plates of the same number formed on the lower body, receiving slots being formed between adjacent spacer plates and extending to a rear portion for receiving therein the clips, each of the clips being integrally formed as a single piece and being bent frontward to form two contact plates that form a small included angle therebetween, outward curved sections being formed on and extending upward from the contact plates, a width-reduced intermediate section being formed rearward of each of the contact plates and extending rearward to a rear end section that is bent to form an expanded curved configuration showing resilience, a contact leg extending from a lower end of the rear end section, the male device and the female device both having opposite side portions respectively forming through holes.

Another feature of the present invention is that the contact legs of the plate terminals and the clips of the scissor-type multi-functional connector are mounted to the substrate boards with SMT or insertion and soldering of PCB (such as DIP).

A further objective of the present invention is that the housing of the scissor-type multi-functional connector forms, in front side thereof a frame wall, below which an open space is formed and which defines a first space, front ends of the plate terminals projecting into the first space, the housing forming, in a direction extending rearward, a plurality of receiving slots for receiving the plate terminals, an open space being formed to face downward from the receiving slots, the housing forming the second, third, and fourth spaces sequentially in the longitudinal direction. The second space of the housing has a height smaller than the first space and the third space, and the fourth space is lower than the second space. The third space forms a notch therein.

A further feature of the present invention is that the plate terminals of the scissor-type multi-functional connector corresponds in number to the receiving slots of the housing, each plate terminal having an upper end forming a recessed portion accommodated in the second space of the housing, a projecting tab extending upward from a rear side of the recessed portion and received in the third space of housing, a pawl extending frontward from an upper end of the projecting tab and received in a notch defined inside the third space, a contact leg being located below and rearward of the projecting tab and extending rearward, the contact leg being received in the fourth space of the housing.

A further feature of the present invention is that the pins of the male device and the female device of the scissor-type multi-functional connector have an upper end forming an expanded section that is greater than the holes and a lower end forming in sequence an inclined pawl and a recession, the recession being of substantially the same size as predetermined holes defined in the substrate board and extending downward to form a portion that is greater than the holes of the substrate board.

A further feature of the present invention is that the upper cover of scissor-type multi-functional connector has a front portion forming a working zone and a rear portion forming a base, a plurality of shielding plates extending frontward in the working zone, each of the shielding plates forming a curvedly recessed slot that faces downward, the base forming a block facing downward, the block forming a number of cavities, a rib being formed between the block and the shielding plates.

A further feature of the present invention is that each of the clips of the scissor-type multi-functional connector is integrally formed as a single piece and is bent frontward to form two contact plates that form a small included angle therebetween, outward curved sections being formed on and extending upward from the contact plates, the clip forming, rearward of each contact plate, a width-reduced intermediate section, which extends rearward to a rear end section that is bent to form an expanded curved configuration showing great resilience, a contact leg extending rearward from a lower end of the rear end section.

Yet a further feature of the present invention is that the lower body of the scissor-type multi-functional connector has a front portion forming two opposite side walls, from which protrusions extend downward, a plurality of spacer plates being arranged between the side walls to be positionable against the shielding plates of the upper cover, receiving slots being formed between adjacent spacer plates to extend to a rear portion, a transverse rib being provided rearward of the spacer plates and extending through the receiving slots, a projection and a raised block being sequentially formed rearward of the transverse rib to be opposite to the spacer plates. The projections have a width greater than the spacer plates and the raise blocks are greater in width than the projections.

As compared to the state-of-the-art technology, the multi-functional radio frequency connector of the present invention provides a compound radio frequency connector, which realizes transmission of multiple signals between printed circuit board assemblies according to practical situations. The connector is capable of simultaneous transmission of radio frequency (RF) signals, regular control signals, and power and shows excellent compatibility. The connector adopts surface-mount technology (SMT) or insertion and soldering to a PCB (such as DIP) so as to render high efficiency of assembling, excellent stability, and ease of maintenance and also offer an excellent function of position-shifted connection to thereby realize convenient installation and operation for inspection operators.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
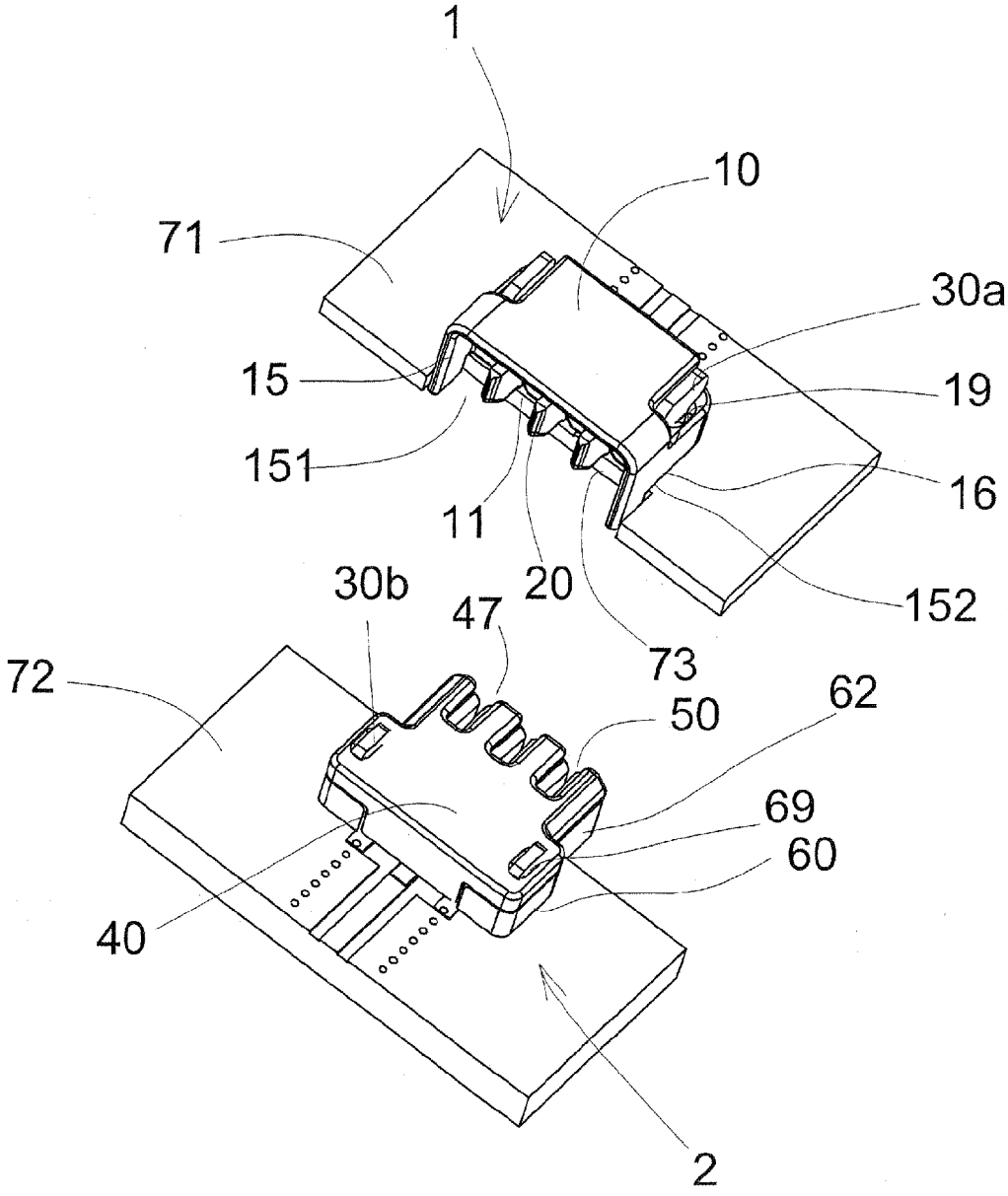
FIG. 1 is a perspective view schematically showing assembling operation of the present invention.

The present invention provides a scissor-type multi-functional connector, which is composed of a male device 1 and a female device 2 respectively mounted on substrate boards 71, 72. As shown in FIG. 1, respectively received and retained inside the two devices 1, 2 are plate terminals 20 and clips 50, both having contact legs mounted to substrate boards 71, 72 with surface mounting technology (SMT). The devices 1, 2 are respectively coupled to the substrate boards 71, 72 with pins 30*a*, 30*b* to ensure stability of the devices and convenient positioning for mounting/dismounting and maintenance. In use, the male device 1 is moved from the upper side of the female device 2 toward a working zone 47 of female device 2 to have the plate terminals 20 fit into corresponding clips 50 thereby realizing surface engagement and connection and thus ensuring high stability of transmission and convenience of operation.

Figure 2:
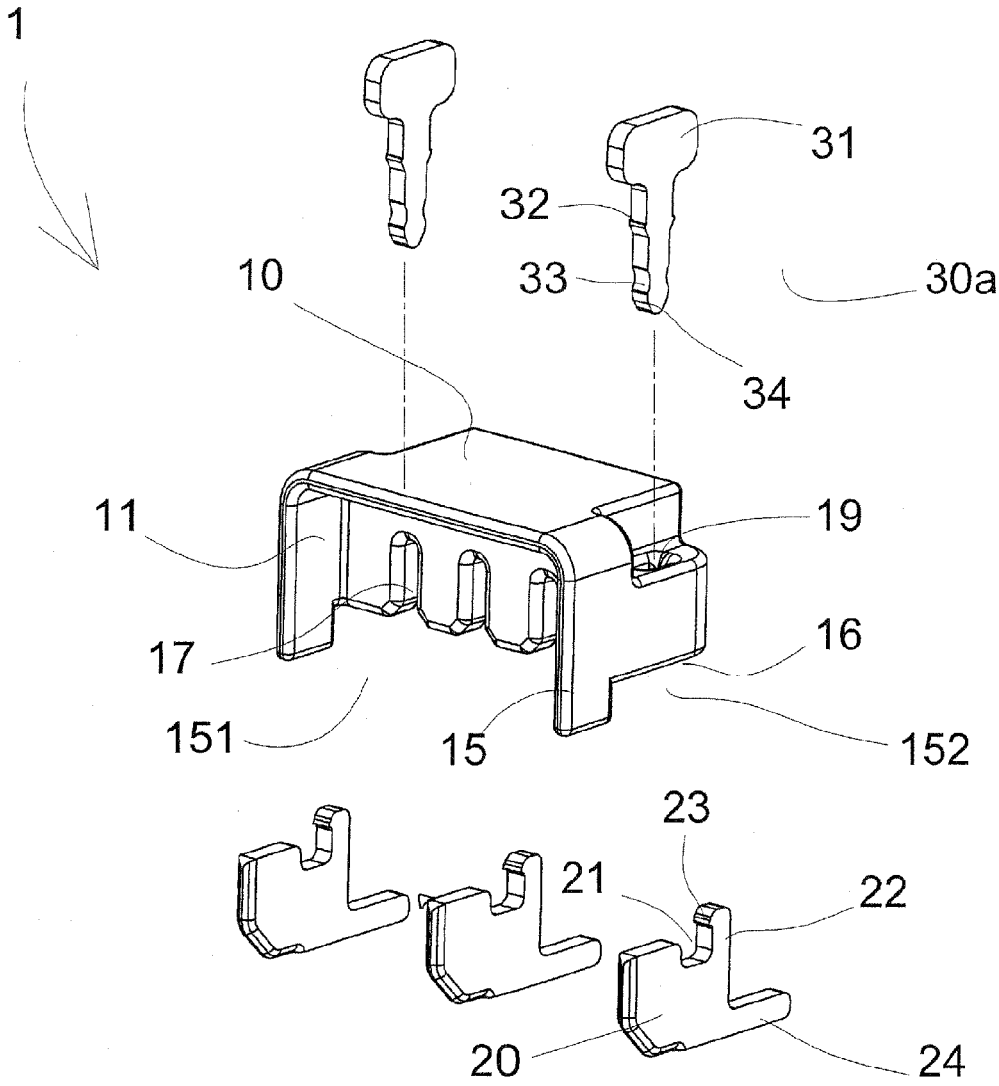
FIG. 2 is an exploded view of a male device of the present invention.
Figure 3:
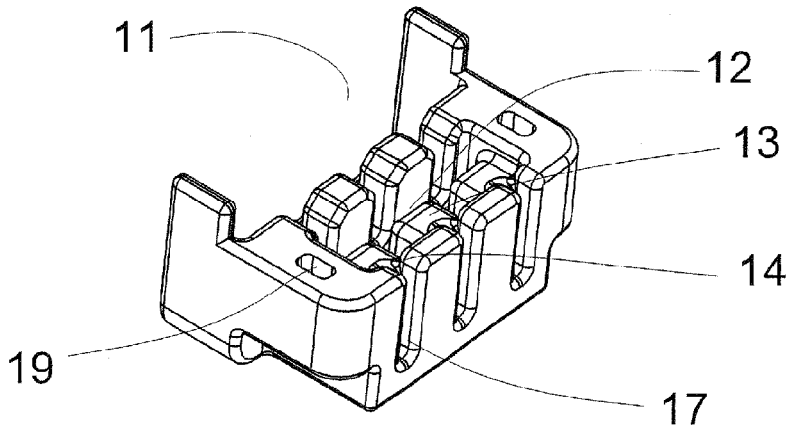
FIG. 3 is a perspective view of a housing of the male device of the present invention taken at a different angle.
Figure 7:
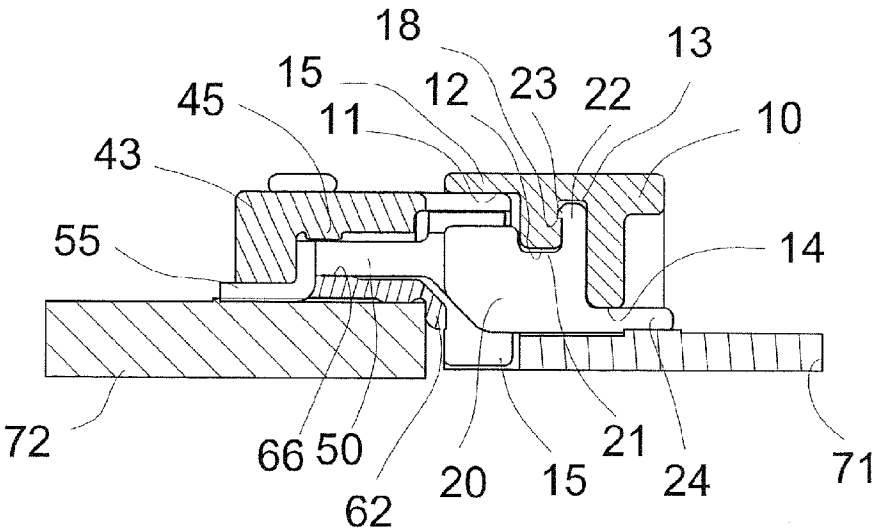
FIG. 7 is a cross-sectional view of the present invention in a connected condition.

As show in FIG. 2, which is an exploded view of the male device 1, the male device 1 comprises a housing 10, a plurality of plate terminals 20, and pins 30*a*. The housing 10 forms, in the front side thereof, a frame wall 15, which defines a first space 11 therein, below which an open space 151 is formed for outward extension of the plate terminals 20 to engage the clips 50 received in the female device 2. The opposite side sections of the frame wall extend to a location lower than the bottom 16 of the housing 10 and consequently, defining a recess 152. Formed behind the first space 11 of the housing 10 is a plurality of receiving slots 17 that extend through the housing 10 for receiving the plate terminals 20 therein. Facing downward from the receiving slots 17 is an open space. As shown in FIGS. 3 and 7, a second space 12, a third space 13, and a fourth space 14 are sequentially inside the housing along a direction of a section thereof, whereby the second space 12 has a height lower than the first space 11 and the third space 13, and the fourth space 14 is lower than the second space 12. Further, two holes 19 are defined in the recess 152 to extend through the housing 10.

The two pins 30*a* are received in the holes 19 of the housing 10 and extend into predetermined holes that are defined in the substrate board 71 for securing the housing 30*a*. Each pin has an upper end forming an expanded section 31 that is greater than the respective hole 19 and a lower end forming, in sequence, an inclined pawl 32 and a recession 33. The pin is retained in the housing 10 by means of the pawl 32. The recession 33 is of the same size as the hole of the substrate board 71 and a bottom portion 34 below the recession 33 is slightly greater in size than the hole of the substrate board. As such the pin, after extending through the hole of the substrate board, is set in such a way that the recession 33 is retained inside the hole so as to secure the housing 10 to the substrate board 71. To dismount, due to the arrangement of the pawl 32, the pins 30*a* help to efficiently separate the housing 10 from the substrate board 71. The pins 30*a* share the same structure and function as the pins 30*b* of the female device 2.

The plate terminals 20 accommodated in the housing 10 has the same quantity as the receiving slots 17 of the housing 10 and three are shown in the drawings. The plate terminal has an upper end forming a recessed portion 21 that is accommodated in the second space 12 of the housing 10. Extending upward from a rear side of the recessed portion 21 is a projecting tab 22, which extends into the third space 13 of housing, and extending frontward from an upper end of the projecting tab 22 is a pawl 23, which extends into a notch 18 defined in a side wall of the third space 13 for positioning and fastening. Located below and rearward of the projecting tab 22 is a contact leg 24 that extends rearward. The contact leg 24 is received in the fourth space 14 of the housing 10.

Figure 4:
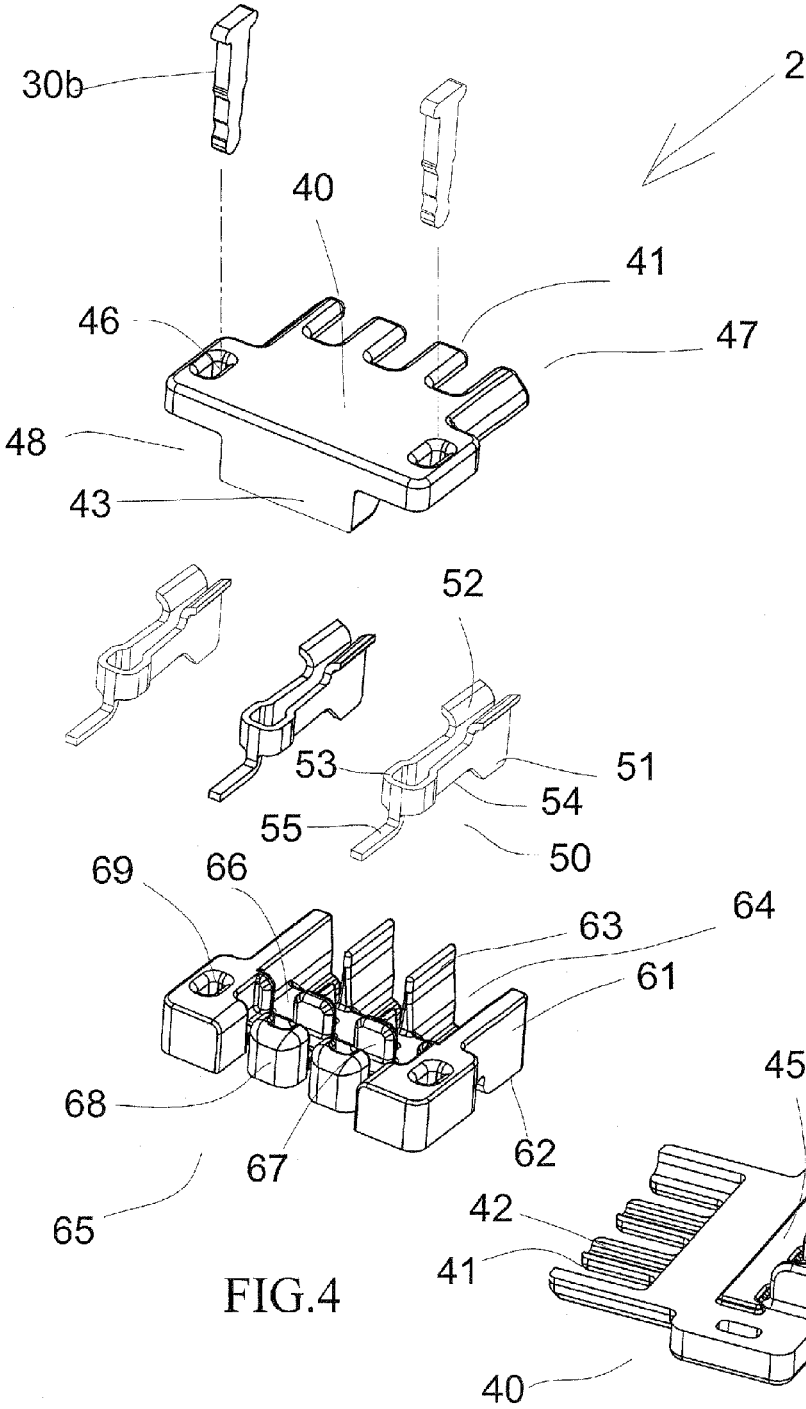
FIG. 4 is an exploded view of a female device of the present invention.

The female device 2 comprises an upper cover 40, the pins 30*b*, the clips 50, and a lower body 60. As shown in FIG. 4, the upper cover 40 has a front portion forming the working zone 47 and a rear portion serving as a base 48. A plurality of shielding plates 41 extends frontward in the working zone 47.

Figure 5:
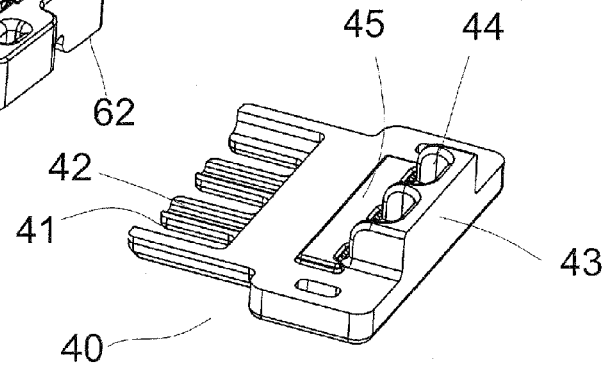
FIG. 5 is a perspective view of an upper cover of the female device of the present invention taken from an opposite side.

Also referring to FIG. 5, each shielding plate 41 forms a curvedly recessed slot 42 that faces downward. The base 48 forms a block 43 facing downward. The block 43 forms a number of cavities 44 of which the number is the same as the shielding plates 41. A rib 45 is formed between the block 43 and the shielding plates 41. Opposite side portions of the upper cover 40 respectively form holes 46 for receiving the pins 30*b* to insert and position therein.

Each clip 50 is integrally formed as a single piece and is bent frontward to form two contact plates 51 that are arranged to form a small included angle therebetween. Formed on and extending upward from the contact plates 51 are outward curved sections 52, which help lead the respective plate terminal 20 to proper position. The clip forms, rearward of each contact plate, a width-reduced intermediate section 54, which extends rearward to a rear end section 53 that is bent to form an expanded curved configuration showing great resilience. Extending rearward from a lower end of the rear end section 53 is a contact leg 55.

The lower body 60, which accommodates the clips 50 therein, has a front portion forming two opposite side walls 61, from which protrusions 62 extend downward. Arranged between the side walls 61 is a plurality of spacer plates 63 that are positionable against the shielding plates 41 of the upper cover 40. The number of the spacer plates are shown in the drawings is three. Formed between adjacent spacer plates 63 is a receiving slot 64, which extends to a rear portion 65. A transverse rib 66 is provided rearward of the spacer plates 63 and extends through all the receiving slots 64. Sequentially formed rearward of the transverse rib to be opposite to the spacer plates 63 are a projection 67 and a raised block 68. The projection 67 has a width greater than the spacer plates 63, so that the width of the section of the receiving slot located therebetween is reduced for accommodating the intermediate section 54 of the respective clip 50. The raised block 58 has a size greater than the projection 67 for accommodating the respective contact leg 55 therebetween. The section of the receiving slot 64 between the projection 67 and the raised block 68 is configured to receive the rear end section 53 of the clip 50 that is of a larger size therein. As such, the receiving slot 64 is arranged to provide respective constrains according to the configuration of the clip 50 and this helps securely holding the clip 50 in the receiving slot 64. The rear portion 65 forms, in opposite side portions thereof, holes 69 corresponding to the holes 46 of the upper cover 40.

As shown in FIG. 1, the male device 1 is set on the substrate board 71 with the frame wall 15 received in a recess 73 defined in the substrate board 71, whereby the recess 152 on the bottom 16 is positioned on the substrate board 71. Then, the pins 30*a* are put through the holes 19 to secure the housing 10 to the substrate board 71. Under this condition, front ends of the plate terminals 20 are received in the first space 11. The female device 2 uses the projections 62 of side walls of the lower body 60 to serve as a reference for positioning on the substrate board 72. Then, the pins 30*b* are put through the holes 69 to secure the female device 2 to the substrate board 72.

Figure 6:
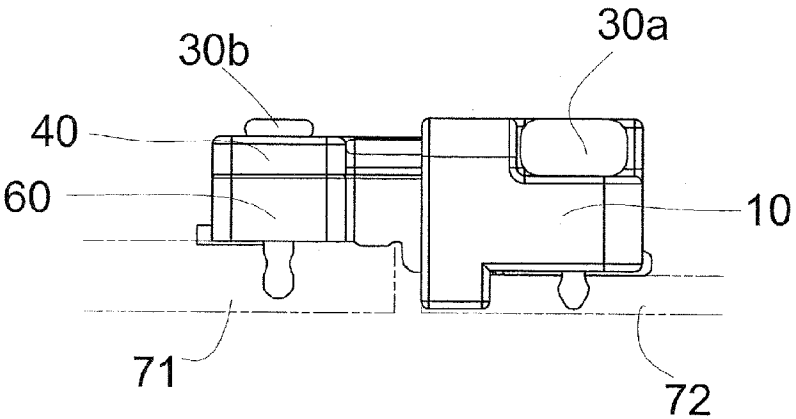
FIG. 6 is a side elevational view of the present invention in a connected condition.

FIGS. 6 and 7 respectively show a side elevational view and a cross-sectional view of the two devices 1, 2 that are connected to each other. As shown in the drawings, the contact legs 24, 55 are mounted to the substrate boards 71, 72 by means of SMT or being inserted into and then soldered to a printed circuit board (such as DIP). The plate terminal 20 is secured by having the pawl 23 of the projecting tab 22 thereof fit into the respective notch 18 of the third space 13 and also with the configuration thereof accommodated in the spaces 12, 13, 14. The female device 2 uses the ribs 45, 66 of the upper cover 40 and the lower body 60 to impose constrain the rear end sections 53, and uses the block 43 to abut against the contact legs 55, to realize securing of the plate terminals 20.

If desired, the plate terminals can be arranged to have a number of 3, 5, or to meet the needs for various connector.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A scissor-type multi-functional connector, comprising a male device and a female device respectively mounted to substrate boards with pins, wherein:

the male device comprises a housing, at least three plate terminals, and the pins, the housing forming a plurality of receiving slots for receiving the plate terminals, the housing forming a plurality of spaces arranged in a direction for accommodating a configuration of the respective plate terminal, each of the plate terminals forming a rearward-extending contact leg; and the female device comprises an upper cover, the pins, clips, and a lower body, the upper cover having a plurality of shielding plates extending frontward for mating spacer plates of the same number formed on the lower body, receiving slots being formed between adjacent spacer plates and extending to a rear portion for receiving therein the clips, each of the clips being integrally formed as a single piece and being bent frontward to form two contact plates that form a small included angle therebetween, outward curved sections being formed on and extending upward from the contact plates, a width-reduced intermediate section being formed rearward of each of the contact plates and extending rearward to a rear end section that is bent to form an expanded curved configuration showing resilience, a contact leg extending from a lower end of the rear end section, the male device and the female device both having opposite side portions respectively forming through holes.

2. The scissor-type multi-functional connector according to claim 1, characterized in that the contact legs of the plate terminals and the clips are mounted to the substrate boards with SMT or DIP.

3. The scissor-type multi-functional connector according to claim 1, characterized in that the housing forms, in front side thereof a frame wall, below which an open space is formed and which defines a first space, front ends of the plate terminals projecting into the first space, the housing forming, in a direction extending rearward, a plurality of receiving slots for receiving the plate terminals, an open space being formed to face downward from the receiving slots, the housing forming the second, third, and fourth spaces sequentially in the longitudinal direction.

4. The scissor-type multi-functional connector according to claim 3, characterized in that the second space of the housing has a height smaller than the first space and the third space, the fourth space being lower than the second space, the third space forming a notch therein.

5. The scissor-type multi-functional connector according to claim 1, characterized in that the plate terminals corresponds in number to the receiving slots of the housing, each plate terminal having an upper end forming a recessed portion accommodated in the second space of the housing, a projecting tab extending upward from a rear side of the recessed portion and received in the third space of housing, a pawl extending frontward from an upper end of the projecting tab and received in a notch defined inside the third space, a contact leg being located below and rearward of the projecting tab and extending rearward, the contact leg being received in the fourth space of the housing.

6. The scissor-type multi-functional connector according to claim 1, characterized in that the pins of the male device and the female device have an upper end forming an expanded section that is greater than the holes and a lower end forming in sequence an inclined pawl and a recession, the recession being of substantially the same size as predetermined holes defined in the substrate board and extending downward to form a portion that is greater than the holes of the substrate board.

7. The scissor-type multi-functional connector according to claim 1, characterized in that the upper cover has a front portion forming a working zone and a rear portion forming a base, a plurality of shielding plates extending frontward in the working zone, each of the shielding plates forming a curvedly recessed slot that faces downward, the base forming a block facing downward, the block forming a number of cavities, a rib being formed between the block and the shielding plates.

8. The scissor-type multi-functional connector according to claim 1, characterized in that each of the clips is integrally formed as a single piece and is bent frontward to form two contact plates that form a small included angle therebetween, outward curved sections being formed on and extending upward from the contact plates, the clip forming, rearward of each contact plate, a width-reduced intermediate section, which extends rearward to a rear end section that is bent to form an expanded curved configuration showing great resilience, a contact leg extending rearward from a lower end of the rear end section.

9. The scissor-type multi-functional connector according to claim 1, characterized in that the lower body has a front portion forming two opposite side walls, from which protrusions extend downward, a plurality of spacer plates being arranged between the side walls to be positionable against the shielding plates of the upper cover, receiving slots being formed between adjacent spacer plates to extend to a rear portion, a transverse rib being provided rearward of the spacer plates and extending through the receiving slots, a projection and a raised block being sequentially formed rearward of the transverse rib to be opposite to the spacer plates.

10. The scissor-type multi-functional connector according to claim 9, characterized in that the projections have a width greater than the spacer plates and the raise blocks are greater in width than the projections.

* * * * *